US007362995B2

(12) United States Patent
Nuita

(10) Patent No.: US 7,362,995 B2
(45) Date of Patent: Apr. 22, 2008

(54) FIXING DEVICE

(75) Inventor: Akira Nuita, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/079,382

(22) Filed: Mar. 15, 2005

(65) Prior Publication Data

US 2007/0071516 A1 Mar. 29, 2007

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 3,965,334 A * 6/1976 Asselman et al. ..... 219/399
5,300,996 A * 4/1994 Yokoyama et al. ..... 399/69

FOREIGN PATENT DOCUMENTS

JP 8-292669 A 11/1996
JP 2004046089 A * 2/2004
JP 2004-109649 A 4/2004

OTHER PUBLICATIONS

U.S. Appl. No. 11/079,385, filed Mar. 15, 2005, Nuita.

* cited by examiner

*Primary Examiner*—David M. Gray
*Assistant Examiner*—Erika J. Villaluna
(74) *Attorney, Agent, or Firm*—Foley & Lardner LLP

(57) ABSTRACT

A fixing device of the present invention supports rotatably a fixing belt heated by a heating member using a separation roller having hollow pipes arranged between a core roller and an outer peripheral roller and producing a high heat insulating effect though it is light in weight and inexpensive and prevents the fixing belt from falling in temperature due to the separation roller.

12 Claims, 4 Drawing Sheets

FIXING DEVICE

FIELD OF THE INVENTION

The present invention relates to a fixing device to fix a toner image on a recording medium using a fixing belt in a copier or a printer for forming an image by an electrophotographic method.

DESCRIPTION OF THE BACKGROUND

In an image forming apparatus such as an electro-photographic copying apparatus and a printer, in recent years, a belt type fixing device has been developed. The belt type fixing device can set a long fixing time, so that even in a color image composed of superimposed toner images, a satisfactory fixing property can be obtained. Some belt type fixing device stretches an endless fixing belt between a heating roller and a separation roller, heats the fixing belt by the heating roller, and inserts a sheet of paper through a nipper section between the fixing belt and a pressure roller to heat, pressurize, and fix a toner image. The fixing belt, to obtain high-speed and satisfactory fixing, is required to shorten the warming-up time and retain a predetermined fixing temperature. For the purpose, the separation roller for supporting the fixing belt together with the heating roller is required to use a highly heat insulating roller to prevent the fixing belt from cooling and furthermore is required to reduce the weight to realize compactness, lightweight, and energy conservation of the apparatus.

Conventionally, in Japanese Patent Application Publication 2004-109649, an apparatus having a plurality of heat pipes installed inside a central part of a core bar of a fixing roller is disclosed. However, the pipes are structured so as to be installed inside the core bar and uniformly diffuse heat to the core bar. Namely, the pipes do not form a heat insulation structure between the hollows of the pipes and the core bar. Further, in Japanese Patent Application Publication No. 8-292669, a separation roller composed of a hollow pipe, inside which air is sent, for making contact with the outside of a fixing belt, suddenly cooling a sheet of paper after heating and fixing, and separating the sheet of paper from the fixing belt is disclosed. However, in the aforementioned separation roller, the fixing belt is also cooled together with the sheet of paper and the temperature of the fixing belt cannot be retained.

Furthermore, as a heat insulating separation roller, there are a roller composed of heat resistant silicone rubber or heat resistant sponge and a ceramic roller covered with a PFA (perfluoroalkyl vinyl ether) tube available. However, the heat resistant silicone rubber and heat resistant sponge have comparatively high thermal conductivity, thus a higher heat insulating effect cannot be obtained, and the warming-up time cannot be shortened. Furthermore, the ceramics roller produces a heat insulation effect by an air layer contained in ceramics, contributes to shortening of the warming-up time, though it is difficult to ensure the manufacturing accuracy, requires a damage prevention measure, thereby is comparatively expensive.

Therefore, in the separation roller using the fixing belt, a fixing device for preventing the temperature of the fixing belt heated by the heating roller from being taken by the separation roller during rotation of the fixing belt, retaining the fixing temperature of the fixing belt, shortening the warming-up time, improving the fixing efficiency, and obtaining a fixed image of high image quality is desired.

SUMMARY OF THE INVENTION

An object of the present invention, in a fixing device using a fixing belt, is to shorten the warming-up time, retain a predetermined fixing temperature, and obtain a fixed image of high image quality at high speed.

According to an embodiment of the present invention, there is provided the fixing device comprising a fixing belt driven to rotate to make contact with a recording medium; a heating member for heating the fixing belt; a support member to give tension to the fixing belt and support the fixing belt rotatably; and a pressure member to press the fixing belt, characterized by: the support member comprises a roller-shaped core member, an outer peripheral member coaxial with the core member in contact with the fixing belt, and a plurality of pipe-shaped hollow members arranged almost uniformly in a gap between the core member and the outer peripheral member.

DETAILED DESCRIPTION OF THE INVENTION

Figure 1:
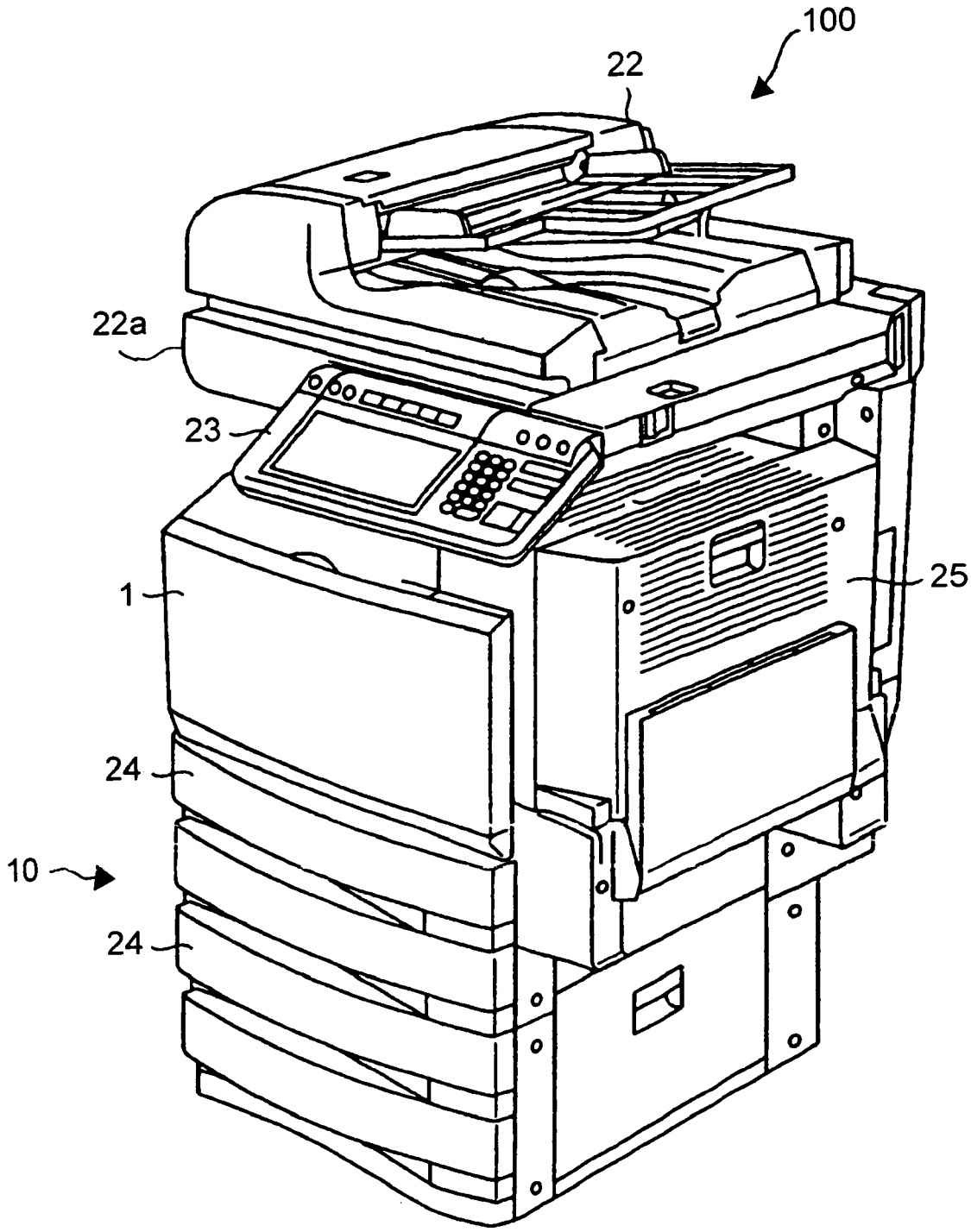
FIG. 1 is an external perspective view of the color image forming apparatus of the embodiment of the present invention.
Figure 2:
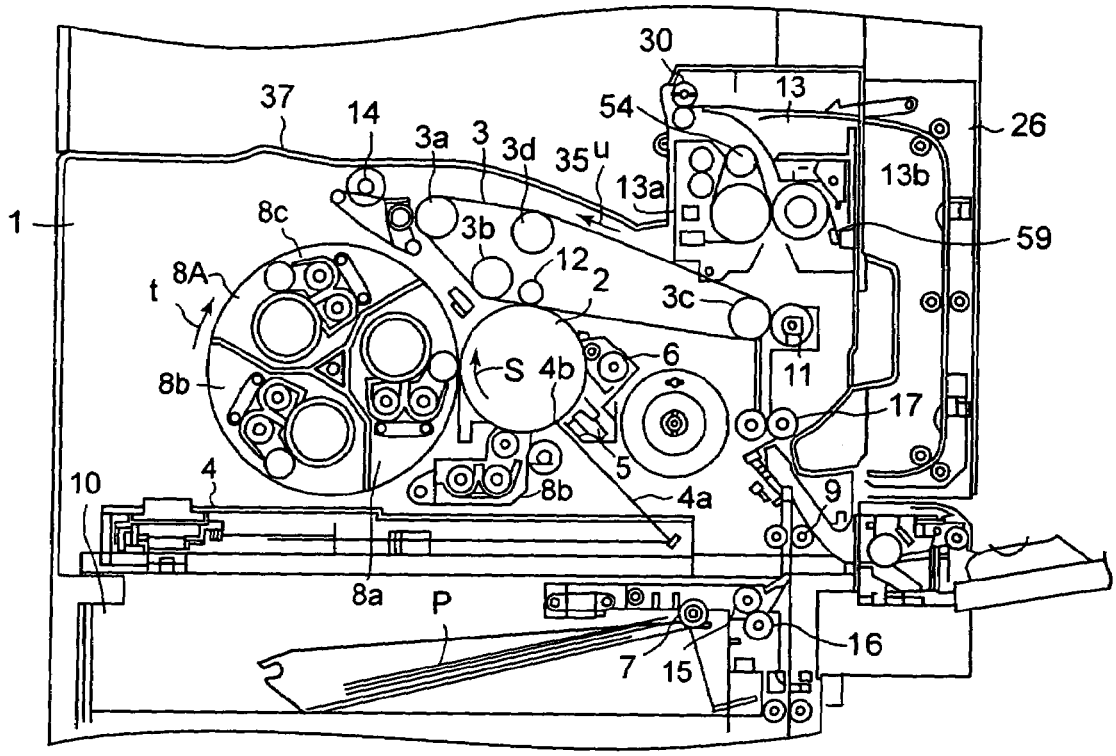
FIG. 2 is a schematic block diagram showing the image forming unit of the color image forming apparatus of the embodiment of the present invention.
Figure 5:
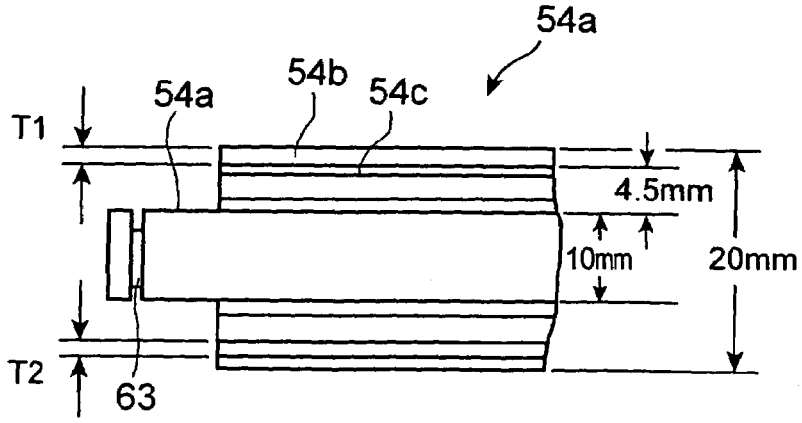
FIG. 5 is a schematic constitution view showing a part of the separation roller the embodiment of the present invention.
Figure 3:
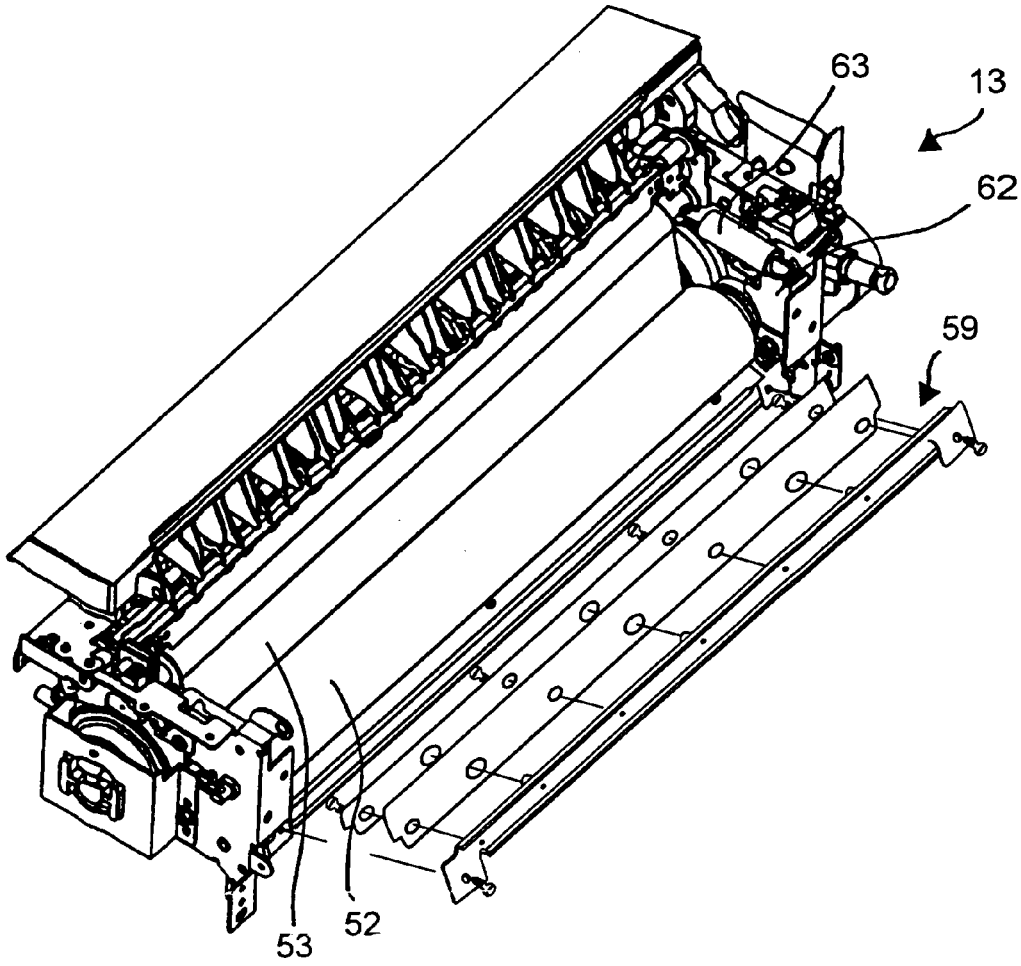
FIG. 3 is a schematic perspective view showing the fixing device of the embodiment of the present invention.
Figure 6:
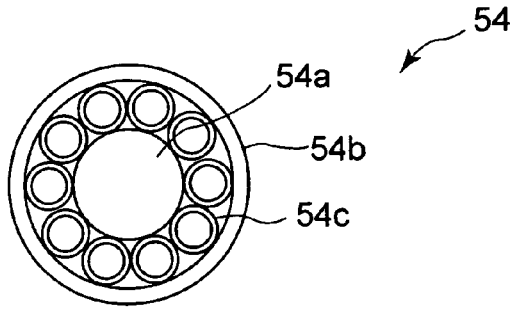
FIG. 6 is a cross sectional view showing the separation roller of the embodiment of the present invention.
Figure 4:
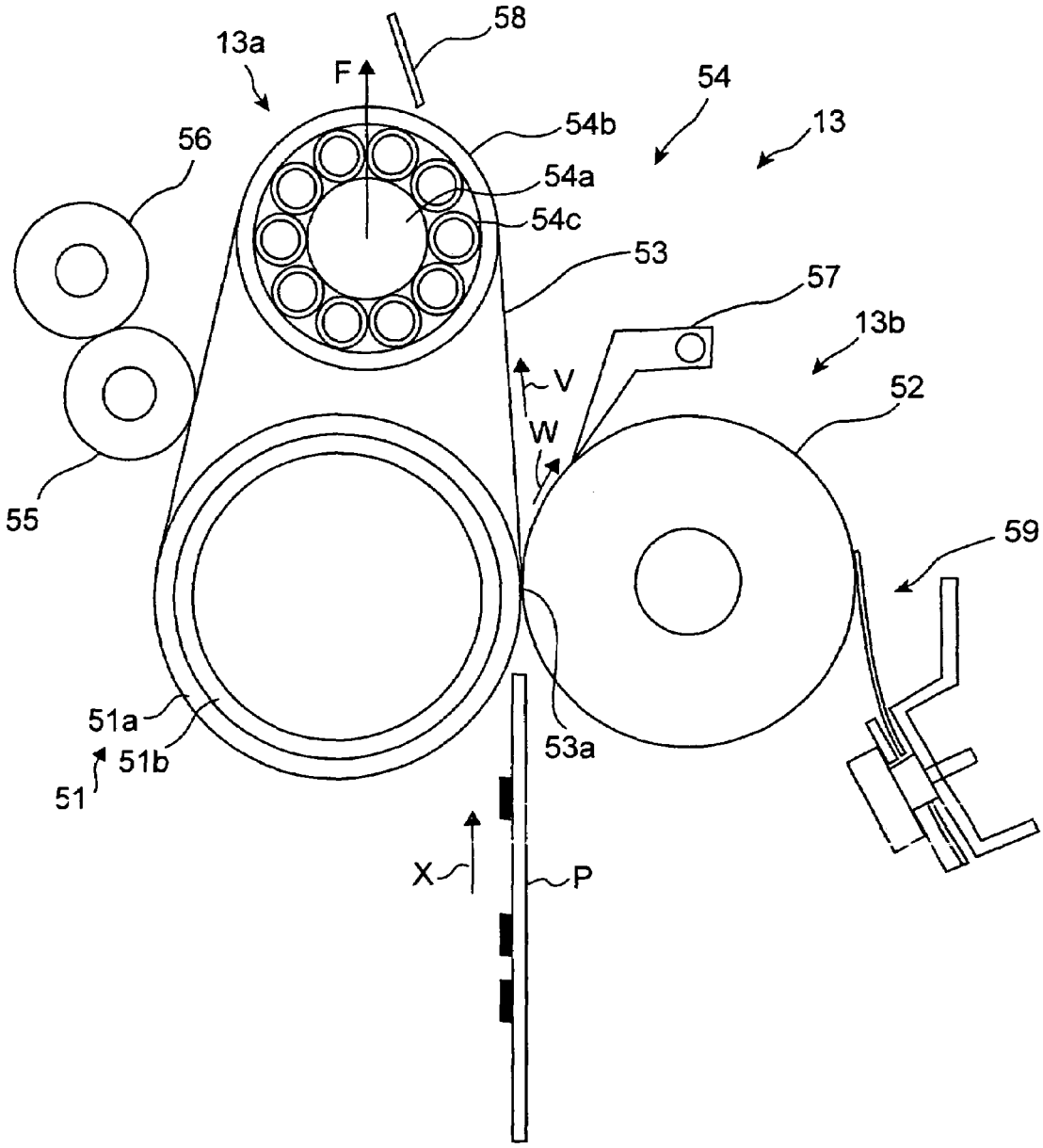
FIG. 4 is a schematic constitution view showing the fixing device of the embodiment of the present invention.

The embodiment of the present invention will be explained below in detail with reference to the accompanying drawings. FIG. 1 is an external perspective view showing color image forming apparatus 100 of an example loading the fixing device of the embodiment of the present invention and FIG. 2 is a schematic block diagram showing image forming unit 1 and paper feed section 10 of color image forming apparatus 100. Above image forming unit 1 of color image forming apparatus 100, document conveying unit 22 for conveying a document to scanner 22*a* is installed and on the upper part of the front of color image forming apparatus 100, operation panel 23 is installed. Under image forming unit 1 of color image forming apparatus 100, paper feed unit 10 composed of a plurality of stages of paper feed cassettes 24 is arranged. On one side of image forming unit 1 of color image forming apparatus 100, reverse conveyor 26 for reversing sheet of paper P at the time of forming both-side images is installed in switchable.

Paper feed unit 10 takes out sheet of paper P by pick-up roller 7 from paper feed cassette 24 and feeds sheet of paper P toward resist roller 17 via separation roller 16 and conveying rollers 9. Around photosensitive drum 2 of image forming unit 1, charger 5 for uniformly charging sequentially photosensitive drum 2 according to the rotation of photosensitive drum 2 in the direction of arrow s, irradiation position 4*b* of laser beam 4*a* from laser exposure apparatus 4 which is a latent image forming section for forming a latent image on charged photosensitive drum 2, black developing apparatus 8B, and color developing apparatus 8A of a revolver type for rotatably supporting developing devices 8*a*, 8*b*, and 8*c* for developing by developers of yellow (Y), magenta (M), and cyan (C) in the direction of arrow t.

Furthermore, around photosensitive drum 2, transfer belt unit 35 having an intermediate transfer belt 3, which is stretched and suspended by driving roller 3*c*, driven roller 3*a*, and tension rollers 3*b* and 3*d* and on which a toner image on photosensitive drum 2 is primarily transferred at the position of primary transfer roller 12, and a cleaner 6 are arranged. Intermediate transfer belt 3 has belt cleaner 14. Further, image forming apparatus 1 has secondary transfer roller 11 for secondarily transferring toner images of a plurality of colors superimposed on intermediate transfer belt 3 onto sheet of paper P which is a recording medium, fixing device 13 of a fixing belt type for fixing the toner images on sheet of paper P, paper ejection rollers 30 for ejecting sheet of paper P after fixing to paper ejection section 31, and reverse conveyor 26.

Next, fixing device 13 will be described. Fixing device 13, as shown in FIGS. 3 to 6, has heating section 13*a* having fixing belt 53 suspended by heating roller 51 which is a heating member and heat insulation separation roller 54 which is a support member and driven by separation roller 54 to rotate in the direction of arrow v. Further, fixing device 13 has pressure section 13*b* having pressure roller 52 pressed to heating roller 51 by pressure arm 62 and pressure spring 63 and rotated in the direction of arrow w at the same speed as that of fixing belt 53. By doing this, between fixing belt 53 supported by heating roller 51 and pressure roller 52, desired nipper section 53*a* is formed.

Heating roller 51 is composed of an iron pipe 51*a* with an outer diameter of 50 mm and a material thickness of 0.75 mm internally including electromagnetic induction coil 51*b* and is inductively heated. Separation roller 54 uses stainless steel (SUS304) of thermal conductivity of 16 W/m-K. Separation roller 54 is composed of hollow pipes 54*c*, which are hollow members, with material thickness T2 of 0.3 mm and an outer diameter of 4.5 mm uniformly arranged between core roller 54*a*, which is a core member, with an outer diameter of 10 mm and outer peripheral roller 54*b*, which is an outer peripheral member, with material thickness T1 of 0.5 mm and an outer diameter of 20 mm. Separation roller 54, since hollow pipes 54*c* are arranged between core roller 54*a* and outer peripheral roller 54*b* to provide a space, can be formed as a structural body of low heat capacity and can produce a high heat insulating effect. Separation roller 54 is pressed in the direction of arrow F so as to always give tension to fixing belt 53 and is driven to rotate by a driving motor not drawn.

In separation roller 54, since material thickness T1 of outer peripheral roller 54*b* is formed so as to be larger than material thickness T2 of hollow pipes 54*c*, there is no fear that the shape of hollow pipes 54*c* may adversely affect the shape of outer peripheral roller 54*b* and outer peripheral roller 54*b* having an even and smooth surface can be obtained.

In separation roller 54, stainless steel core roller 54*a*, outer peripheral roller 54*b* and hollow pipes 54*c* are extended, thus hollow pipes 54*c* are adhered and fixed in a gap between core roller 54*a* and outer peripheral roller 54*b*. Further, slits 63 are formed at both ends of core roller 54*a* of separation roller 54. In separation roller 54, hollow pipes 54*c* are inserted into the gap between core roller 54*a* and outer peripheral roller 54*b*, and then an adhesive is injected into the gap, thus hollow pipes 54*c* may be adhered and fixed in the gap between core roller 54*a* and outer peripheral roller 54*b*.

Fixing belt 53 is composed of a 3-layer belt of a nickel (Ni) substrate laminated with silicone rubber and PFA (perfluoroalkyl vinyl ether). With fixing belt 53, oil roller 55 for feeding oil onto the surface of fixing belt 53 is in contact. With oil roller 55, cleaning roller 56 for adhering and cleaning stains of the surface of oil roller 55 is in contact. Further, in the neighborhood of separation roller 54, separation plate 58 for preventing sheets of paper P from wrapping is installed.

Pressure roller 52 is composed of sponge with an outer diameter of 38 mm. Around pressure roller 52, separation pawl 57 for preventing sheets of paper P from wrapping and cleaning blade unit 59 for scraping and cleaning stains of the surface of the pressure roller are installed.

Next, the color image forming process by image forming unit 1 will be explained. Image forming unit 1 superimposes toner images in the order of black (BK), cyan (C), magenta (M), and yellow (Y) to form a color image.

When the image forming process starts, in fixing device 13, heating roller 51 is heated by electromagnetic induction coil 51*b*, and fixing belt 53 is driven to rotate by separation roller 54 in the direction of arrow v, thus the warming-up is started. At this time, since separation roller 54 is a structural body of low heat capacity, fixing belt 53, when it makes contact with separation roller 54, is not taken greatly the heat given by heating roller 51. Therefore, fixing roller 53 can realize warming-up at high speed.

When fixing roller 53 finishes the warming-up and is put into a ready state, intermediate transfer belt 3 is rotated in the direction of arrow u in correspondence with driving by photosensitive drum 2. Photosensitive drum 2 is uniformly charged by charger 5 according to the rotation in the direction of arrow s, is irradiated with laser beam 4*a* according to a black image signal by laser exposure apparatus 4 to form a black electrostatic latent image, which is developed by black developing apparatus 8B moved to the developing position.

The black (BK) toner image on photosensitive drum 2 is primarily transferred electro-statically onto intermediate transfer belt 3 rotating in the direction of arrow u at the position of primary transfer roller 12. After the primary transfer, photosensitive drum 2 is cleaned residual toner by cleaner 6.

Hereafter, similarly to the black (BK) toner image forming process, the toner image forming processes of cyan (C), magenta (M), and yellow (Y) are sequentially repeated, and toner images of a plurality of colors are superimposed at the same position on intermediate transfer belt 3, thus a full-color toner image is obtained on intermediate transfer belt 3. During this period, black developing apparatus 8B is separated from photosensitive drum 2 and color developing apparatus 8A rotates in the direction of arrow t according to arrival of electrostatic latent images of various colors, thereby arranges sequentially cyan (C) developing device 8*c*, magenta (M) developing device 8*b*, and yellow (Y) developing device 8*a* opposite to photosensitive drum 2.

Hereafter, the full-color toner images of black (BK), cyan (C), magenta (M), and yellow (Y) superimposed on intermediate transfer belt 3 are secondarily transferred onto sheet of paper P in a batch at the secondary transfer position opposite to secondary transfer roller 11. Sheet of paper P is conveyed to the secondary transfer position synchronously with arrival of the full-color toner images on intermediate transfer belt 3 at the secondary transfer position.

Sheet of paper P on which the full-color toner images are formed moves in the direction of arrow x, is conveyed to fixing device 13, and is inserted through nipper section 53*a* between fixing belt 53 and pressure roller 52 to heat, pressurize, and fix the full-color toner images. Sheet of paper P passing through nipper section 53*a* is separated from fixing belt 53 by the stiffness thereof, is guided by separation plate 58, and is ejected from paper ejection roller 30 to paper ejection section 31. However, when sheet of paper P is wrapped in pressure roller 52, it is separated by separation pawl 57.

During this period, fixing belt 53 rotating in the direction of arrow v is heated by contact with heating roller 51 heated by electromagnetic induction coil 51*b*. By doing this, fixing belt 53, in nipper section 53*a* with pressure roller 52, is retained at the fixable temperature. Fixing belt 53, after passing nipper section 53*a*, makes contact with separation roller 54. However, separation roller 54 is a structural body of low heat capacity, so that fixing belt 53 is not taken greatly the heat. Therefore, fixing belt 53, after making contact with separation roller 54, reaches heating roller 51 once again in a state that it is almost kept in the heating state by heating roller 51 and is re-heated by heating roller 51. Further, toner adhered onto the surface of fixing belt 53 is removed by oil roller 55 and then oil roller 55 is cleaned by cleaning roller 56. A stain of pressure roller 52 is scraped by cleaning blade 59.

As mentioned above, in fixing device 13, fixing belt 53 is not taken heat, though it makes contact with separation roller 54. Therefore, fixing belt 53 can be warmed up at high speed and can be kept at the fixable temperature.

Further, when the warming-up time of fixing belt 53 is tested using fixing device 13, compared with a comparison example using a separation roller composed of a heat resistant silicone rubber roller with an outer diameter of 20 mm in an environment at a room temperature of 25° C., the warming-up time up to the fixing temperature 180° C. is improved by about 5%. Further, the weight of separation roller 54 of this embodiment is reduced by about 3% compared with comparison example 1.

According to this embodiment, hollow pipes 54*c* are arranged between core roller 54*a* of separation roller 54 and outer peripheral roller 54*b*, so that separation roller 54 can be formed an a structural body of low heat capacity and although it is light in weight and inexpensive, the heat insulating effect can be increased. Therefore, when fixing belt 53 of fixing device 13 is given tension and driven by such separation roller 54, although it makes contact with separation roller 54, the temperature reduction of the fixing belt can be made smaller and the warming-up can be speeded up. Further, during fixing, the surface temperature of fixing belt 53 can be easily kept at a predetermined fixable temperature and a fixed image of high image quality can be obtained by fixing belt 53.

Further, according to this embodiment, material thickness T1 of outer peripheral roller 54*b* is formed so as to be larger than material thickness T2 of hollow pipes 54*c*, so that there is no fear that the shape of hollow pipes 54*c* may adversely affect the shape of outer peripheral roller 54*b* and outer peripheral roller 54*b* having an even and smooth surface can be obtained easily.

Further, the present invention is not limited to the aforementioned embodiments and can be variously changed within the scope of the present invention, and for example, the structure of an image forming apparatus loading the fixing device using the heat insulating support member of the present invention is not limited, and the transfer method may not use the intermediate transfer belt, and an image forming apparatus of a tandem type arranging a plurality of photoconductor units in parallel is acceptable. Further, in the support member, the material and material thickness thereof are not limited, and in the embodiment, iron may be optionally used instead of stainless steel, though to retain the heat insulating property, a material of thermal conductivity of 90 W/m-K or less is preferably used.

Furthermore, to prevent the shape of the hollow pipes from affecting the outer peripheral roller, material thickness T2 of the hollow pipes is preferably equal to or smaller than material thickness T1 of the outer peripheral roller. Further, the structure of the support member is optional, and the hollow pipes, if they are in a pipe shape, may be elliptic, and between the core roller and the outer peripheral roller, thin hollow pipes may be arranged in a plurality of stages. Furthermore, the core roller may be composed of a pipe instead of a solid roller. Further, the manufacturing process and use of the support member are not limited.

As mentioned above, according to the present invention, between the core roller and the outer peripheral roller, the hollow pipes are arranged uniformly, so that a support member which is light in weight and inexpensive can be obtained easily. Therefore, when such a support member is used to support the fixing belt, the fixing belt can be prevented from reduction in temperature, and the warming-up of the fixing device can be speeded up, and a fixed image of high image quality can be obtained.

What is claimed is:

1. A fixing device, comprising:

a fixing belt driven to rotate to make contact with a recording medium;

a heating member for heating the fixing belt;

a support member to give tension to the fixing belt and support the fixing belt rotatably; and a pressure member to press the fixing belt, wherein the support member comprises a roller-shaped core member, an outer peripheral member coaxial with the core member in contact with the fixing belt, and a plurality of pipe-shaped hollow members arranged almost uniformly in a gap between the core member and the outer peripheral member, and wherein the core member, the outer peripheral member, and the hollow members have thermal conductivity of 90 W/m-k or less.

2. The fixing device according to claim 1, wherein the hollow members are adhered and fixed in the gap between the core member and the outer peripheral member.

3. The fixing device according to claim 1, wherein the hollow members are adhered and fixed by an adhesive in the gap between the core member and the outer peripheral member.

4. The fixing device according to claim 1, wherein assuming a material thickness of the outer peripheral member as T1 and a material thickness of the hollow members as T2, T1≧T2.

5. The fixing device according to claim 1, wherein the heating member is a heating roller internally having heating means and the support member is a separation roller having a smaller diameter than that of the heating roller.

6. The fixing device according to claim 5, wherein the pressure member presses the fixing belt at a position of the heating roller.

7. A fixing device, comprising:

a fixing belt driven to rotate to make contact with a recording medium;

a heating roller to heat the fixing belt;

a separation roller to give tension to the fixing belt together with the heating roller and supporting rotatably the fixing belt; and a pressure roller to press the fixing belt, wherein the separation roller comprises a core roller, an outer peripheral roller coaxial with the core roller in contact with the fixing belt, and a plurality of hollow pipes arranged almost uniformly in a gap between the core roller and the outer peripheral roller, and wherein the core roller, the outer peripheral roller, and the hollow pipes have thermal conductivity of 90 W/m-K or less.

8. The fixing device according to claim 7, wherein the hollow pipes are adhered and fixed in the gap between the core roller and the outer peripheral roller.

9. The fixing device according to claim 7, wherein the hollow pipes are adhered and fixed by an adhesive in the gap between the core roller and the outer peripheral roller.

10. The fixing device according to claim 7, wherein assuming a material thickness of the outer peripheral roller as T1 and a material thickness of the hollow pipes as T2, T1≧T2.

11. The fixing device according to claim 7, wherein a diameter of the separation roller is made smaller than a diameter of the heating roller.

12. The fixing device according to claim 7, wherein the pressure roller presses the fixing belt at a position of the heating roller.

* * * * *